US006679191B2

(12) United States Patent
Shibata

(10) Patent No.: US 6,679,191 B2
(45) Date of Patent: Jan. 20, 2004

(54) FABRIC TENSIONING DEVICE FOR SEWING MACHINE

(75) Inventor: Masanori Shibata, Ichinomiya (JP)

(73) Assignee: Kabushikikaisha Barudan, Aichi-Ken (JP)

( * ) Notice: Subject to any disclaimer, the term of this patent is extended or adjusted under 35 U.S.C. 154(b) by 0 days.

(21) Appl. No.: 10/334,426

(22) Filed: Dec. 30, 2002

(65) Prior Publication Data

US 2003/0209180 A1 Nov. 13, 2003

(30) Foreign Application Priority Data

May 13, 2002 (JP) ..... 2002-137663

(51) Int. Cl.[7] ..... D05C 9/04
(52) U.S. Cl. ..... 112/470.31
(58) Field of Search ..... 112/103, 470.31, 112/470.33, 470.14, 121, 475.18, 475.11

(56) References Cited

U.S. PATENT DOCUMENTS 5,553,560 A * 9/1996 Tajima et al. ..... 112/103
5,887,534 A * 3/1999 French et al. ..... 112/103
5,915,314 A * 6/1999 Moore, III ..... 112/103
6,213,037 B1 * 4/2001 Hattori et al. ..... 112/103
6,532,882 B1 * 3/2003 Tajima et al. ..... 112/103

FOREIGN PATENT DOCUMENTS

JP 401239151 * 9/1989
WO WO 00/53836 9/2000

* cited by examiner

*Primary Examiner*—Ismael Izaguirre
(74) *Attorney, Agent, or Firm*—Darby & Darby

(57) ABSTRACT

The present invention provides a fabric tensioning device for stretching fabric on a sewing machine. The fabric tensioning device includes a cylindrical frame having a window extending in a longitudinal direction. A fabric clamping member clamps down the cloth material against the frame for presenting the material to the embroidery needle at the window in a tensioned state. The clamping member opens and closes on the frame and has a pair of opposing fabric clamps on the left and right side of the frame that are oblong in the longitudinal direction with open front edges. The fabric clamps are tightened against the frame by belts in the front and rear thereof.

5 Claims, 11 Drawing Sheets

FABRIC TENSIONING DEVICE FOR SEWING MACHINE

BACKGROUND OF THE INVENTION

1. Field of the Invention

The invention relates to a fabric tensioning device for stretching work fabric in the sewing location of a sewing machine.

2. Description of Related Art

Devices for tensioning a piece of tube-like fabric, such as a material for socks and wrist bands, using a cylindrical frame are used in embroidering on a sewing machine. One of such fabric tensioning device is disclosed in International Patent Publication Number WO0/53836. This device has a cylindrical frame 101 that is placed to cover the outside of the cylinder bed (not shown) of the sewing machine as shown in FIG. 11. A sewing window 102 is formed in cylindrical frame 101 for exposing the sewing, area of the cylinder bed. A fabric clamping member 103 capable of opening and closing vertically is provided in order to clamp down the fabric, which is arranged to cover sewing window 102, against cylindrical frame 101. Fabric clamping member 103 is formed by bending a steel rod to form a rectangular shape with a closed front end, to clamp down the fabric against cylindrical frame 101 to hold it on three sides, i.e., the front, left and right sides, of the sewing area.

However, with this fabric tensioning device, because fabric clamping member 103 is a frame-like member made of a highly rigid material, the contact of fabric clamping member 103 against the fabric is often localized. This causes a clamp mark in a certain area, and insufficient clamping in other areas of the fabric, which are all undesirable. Moreover, since fabric clamping member 103 does not hold the fabric on the rear side of the sewing area, it may cause looseness in the fabric on the left and right sides of the sewing area particularly when the fabric is a thin or slippery piece of processed fabric, thus affecting the sewing accuracy.

SUMMARY OF THE INVENTION

The present invention provides a fabric tensioning device for a sewing machine that can solve the abovementioned problems by holding down the fabric on the four sides of the sewing area evenly and stretching the fabric securely on the cylindrical frame without causing any clamping marks or slacks.

In order to solve the abovementioned problems, the fabric tensioning device according to the present invention comprises a cylindrical frame having a sewing window and a fabric clamping member for clamping down against said cylindrical frame a work fabric that is covering said sewing window, wherein said fabric clamping member is provided in such a way as to be able to open or close against said cylindrical frame, and said fabric clamping member is equipped with a pair of fabric clamps on the left and right hand side that are oblong in the longitudinal direction having open-end front edges, wherein said fabric clamps are tightened against said cylindrical frame at the front and rear ends of a sewing area by means of a pair of belts provided in the front and the rear of the area.

While the direction that the fabric clamping member opens or closes can either be a vertical direction or a lateral direction, it is preferable for the fabric clamping member to be mounted in such a way to open or close in the lateral direction as it makes it easier to open the sewing window fully and to spread the fabric over the area. It is preferable in this case that the fabric clamping member is pivot-mounted on the cylindrical frame at a location outside of one of the fabric clamps so that a wide space can be formed between the fabric clamp and the cylindrical frame and the work fabric can be easily inserted. More specifically, it is preferable to form the fabric clamping member in a rectangular shape with an open-ended front edge by connecting the rear end of the left and right hand side fabric clamps, and to attach the rear end of the fabric clamping member to the cylindrical frame via a pivot shaft located outside of one of the fabric clamps so that the fabric clamping member can be opened in the lateral direction.

The belts that tighten the fabric clamps do not have to be made of a specific kind of material; for example, rubber belts, fabric belts, surface fastener belts, etc., can be used, as long as they are flexible so that they are unlikely to leave clamping marks. Surface fastener belts with open-ends are preferable as they can be used to tighten the fabric clamps with one-touch operation. It is preferable in this case to provide a surface fastener on one of the fabric clamps in such a way that the position of the rear belt can be adjusted in the forward and backward direction in order to be able to tighten the fabric clamp close to the rear end of the stitch forming area as needed in accordance with the sewing area of an embroidery pattern, etc. The front belt should preferably be threaded through the hole provided on the front end of the left and right fabric clamps so that it will not be lost.

DETAILED DESCRIPTION OF THE PREFERRED EMBODIMENTS

Figure 1:
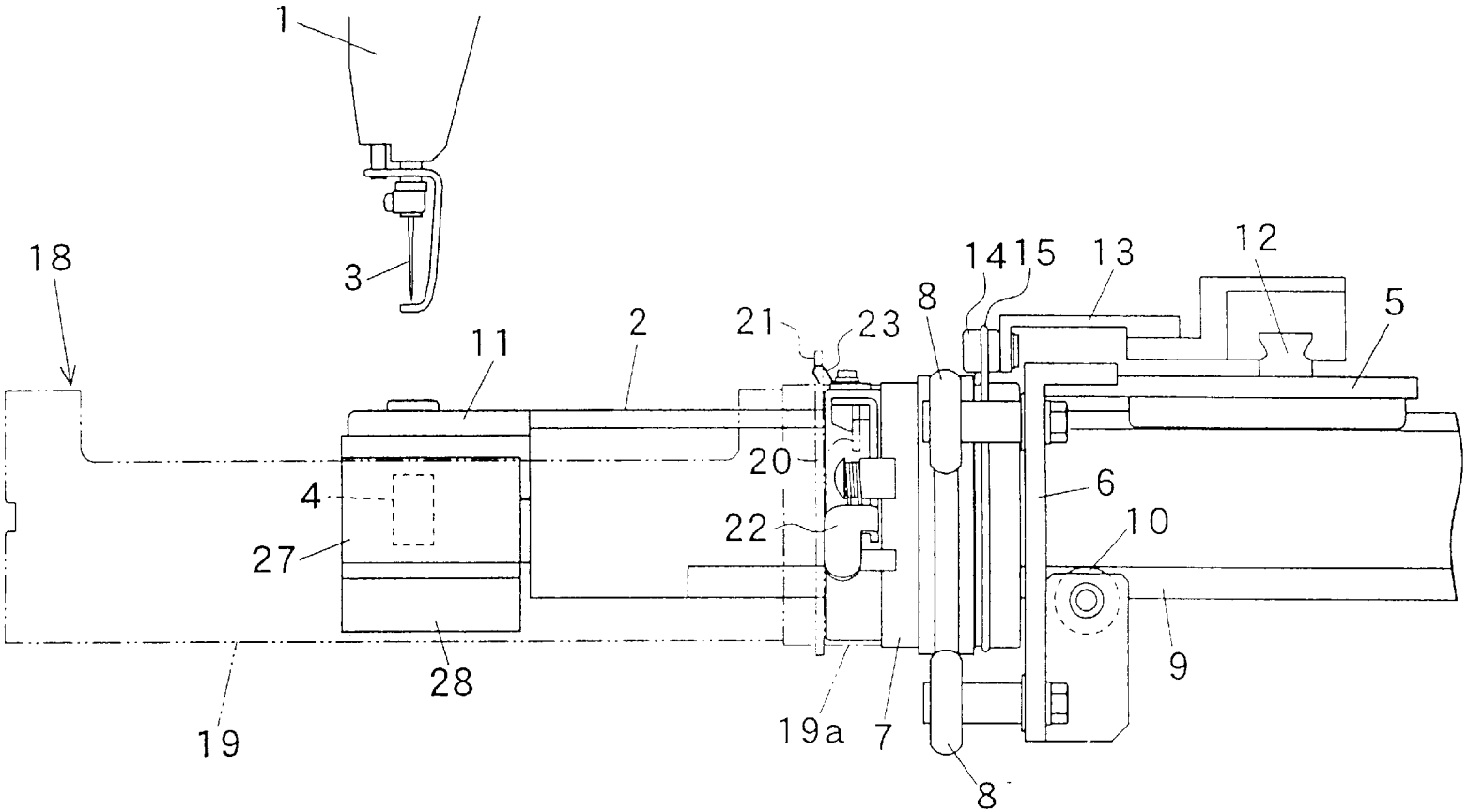
FIG. 1 is a side view of a cylinder bed according to an embodiment of the invention.
Figure 2:
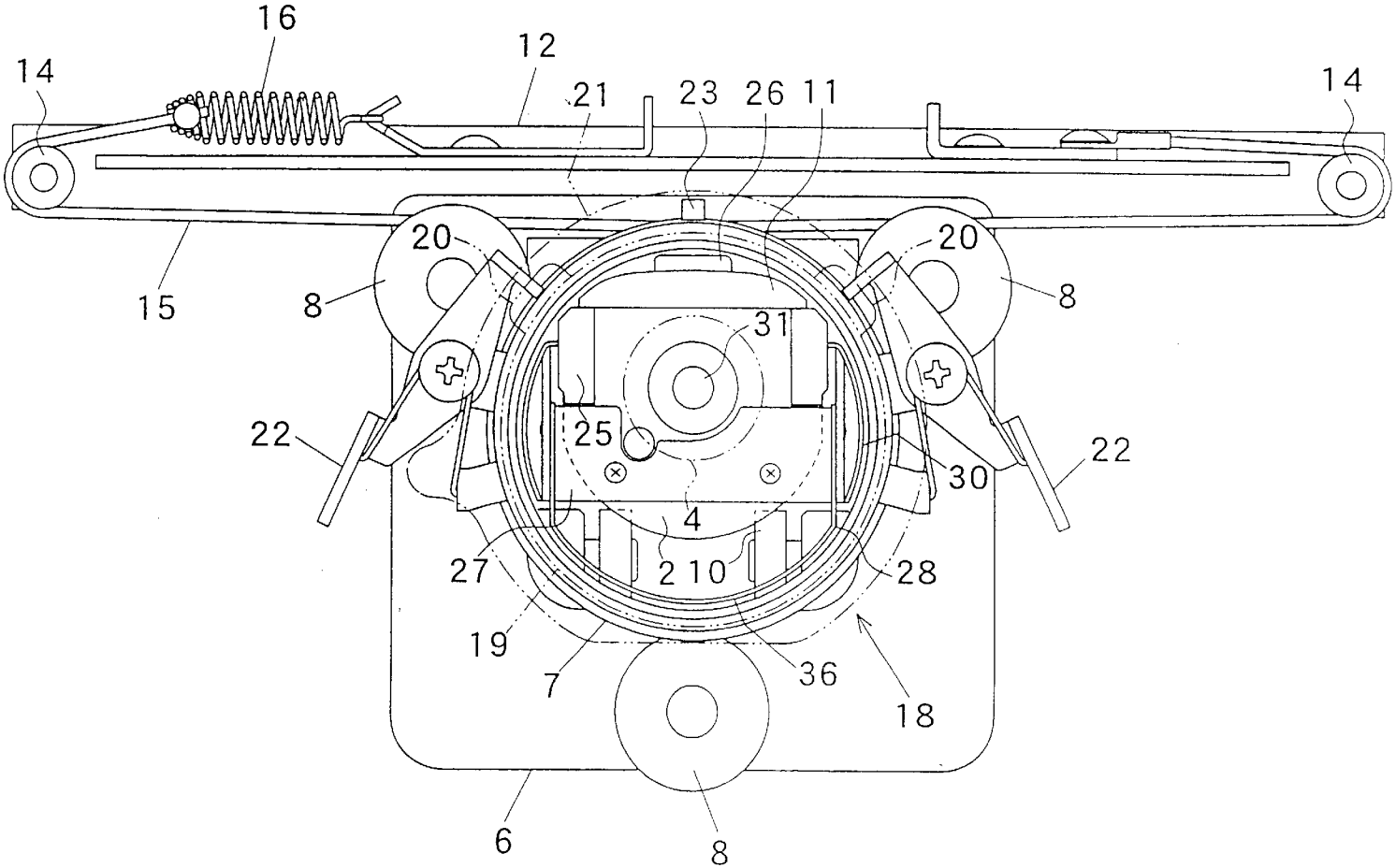
FIG. 2 is a front view of the bed according to an embodiment of the invention.

An embodiment of the invention on an embroidering sewing machine will be described below with reference to the accompanying drawings. As shown in FIG. 1 and FIG. 2, a head 1 and a cylinder bed 2 are displaced in a vertical direction in the machine frame (not shown) of a the sewing machine, and a needle 3 is attached to the bottom end of head 1, while a bobbin case 4 and a needle plate 11 are provided at the front end of cylinder bed 2. A Y-direction moving body 5 is supported by the top surface of cylinder bed 2, and a base plate 6 is connected vertically to moving body 5. Three rollers 8 are displaced on the front side of base plate 6 in order to support a drive ring 7, while two guide rollers 10 are provided on the back side of base plate 6 engaging with two bottom grooves 9 on the left and right sides of cylinder bed 2.

An X-direction moving body 13 is supported via a rail 12 provided on the top of Y-direction moving body 5, while a pulley 14 is provided at the left and right ends of moving body 13 respectively. A wire rope 15 is provided on pulleys 14 tightly stretched by means of a spring 16, while rope 15 is wrapped around drive ring 7 in the middle. Y-direction moving body 5 and X-direction moving body 13 are connected to a sewing frame driving device (not shown) of the sewing machine, and Y-direction moving body 5 strokes drive ring 7 in a reciprocating manner in the axial direction (front and rear direction) of cylinder bed 2 via base pate 6, while X-direction moving body 13 rotates drive ring 7 in a reciprocating manner around the axis of cylinder head 2 via wire rope 15.

Figure 4:
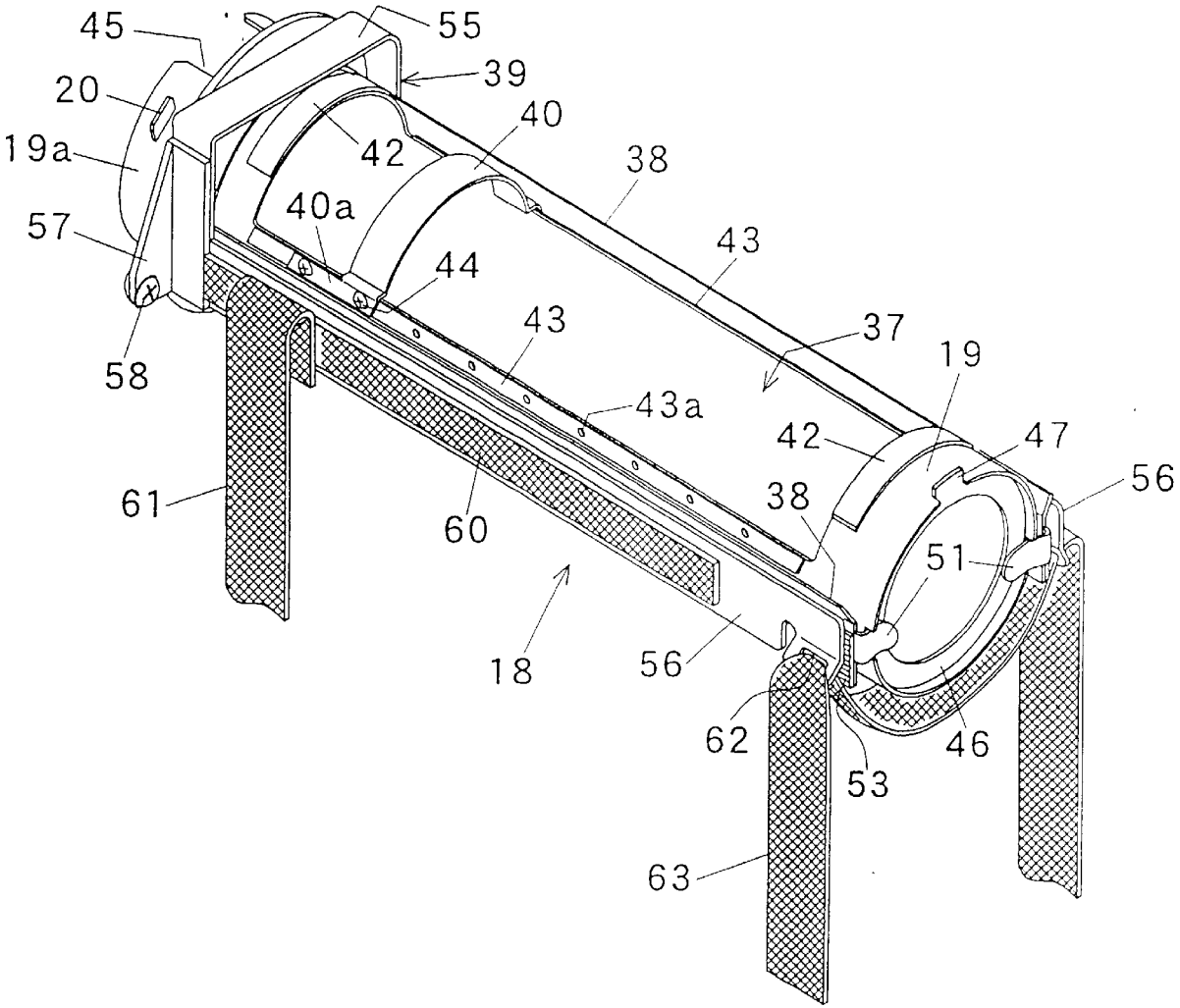
FIG. 4 is a perspective view of a fabric tensioning device of the bed according to an embodiment of the invention.
Figure 5:
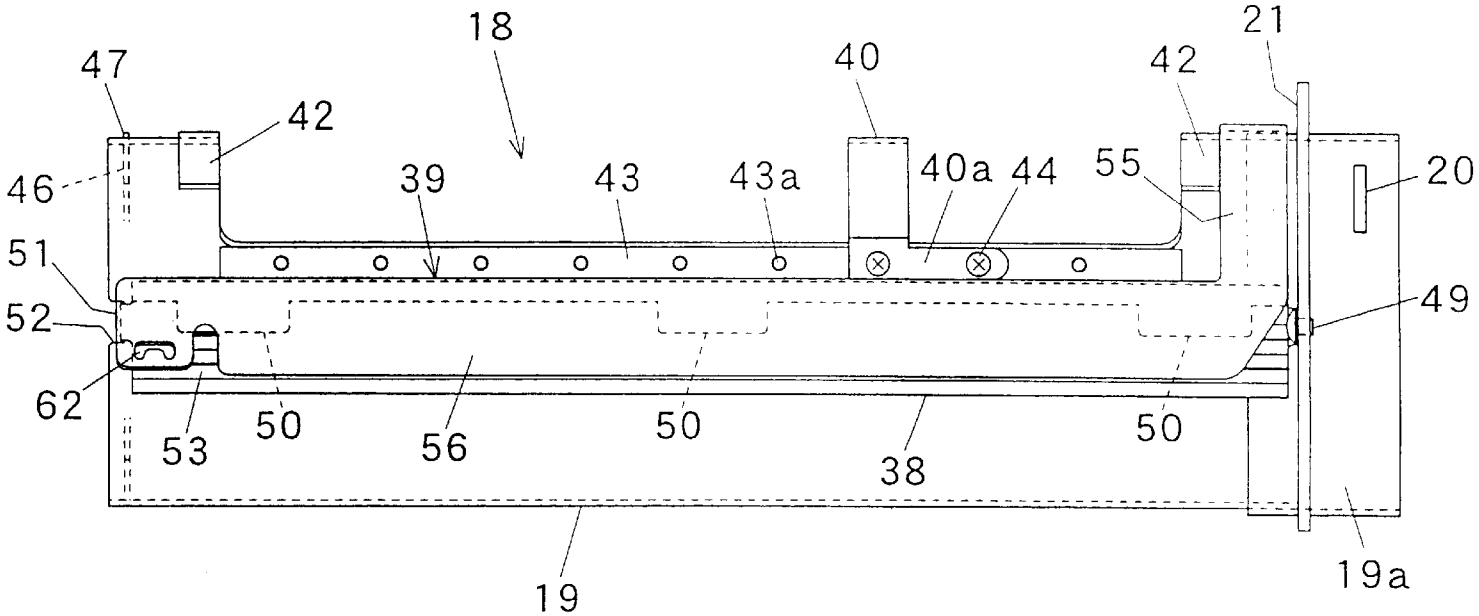
FIG. 5 is a side view of the fabric tensioning device according to an embodiment of the invention.
Figure 6:
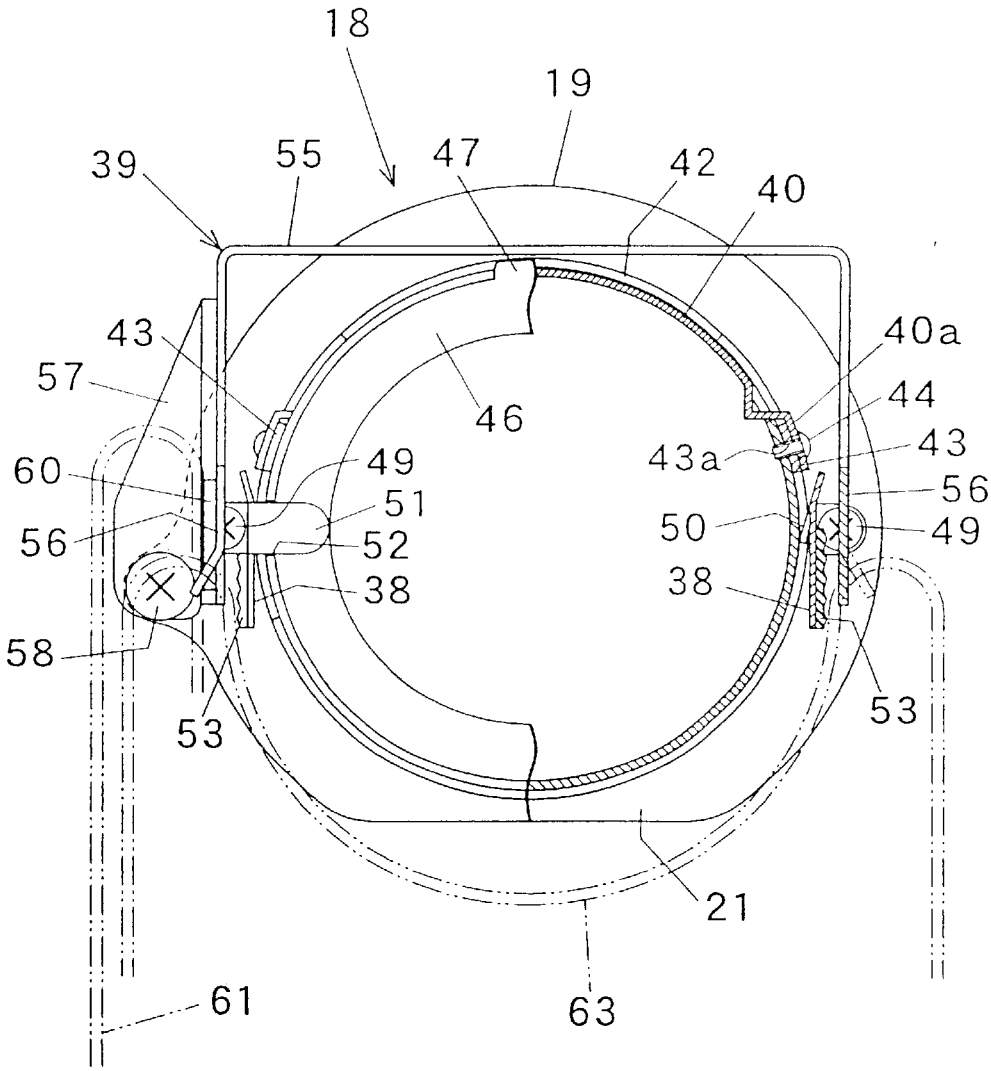
FIG. 6 is a partially broken front view of the fabric tensioning device according to an embodiment of the invention.

In an embroidering process of a piece of tube-like fabric such as a material for socks and wrist bands, a cylindrical frame 19 of fabric tensioning device 18 is placed to cover the outside of cylinder bed 2 and is attached to drive ring 7 via a mounting part 19*a* at its rear end. A latching piece 20 and a flange 21 are provided protrusively on the rear outer periphery of cylindrical frame 19 (see FIG. 4), while a lever 22 that engages with latching piece 20 and a spring 23 that elastically contacts with flange 21 are provided on drive ring 7. Thus, cylindrical frame 19 is connected tightly to drive ring 7 via lever 22 and spring 23 and driven together with drive ring 7 in the axial and circumferential directions relative to the axis of cylinder bed 2 in order to sew on the fabric stretched around cylindrical frame 19 in the cooperation of needle 3 and bobbin case 4.

Figure 3:
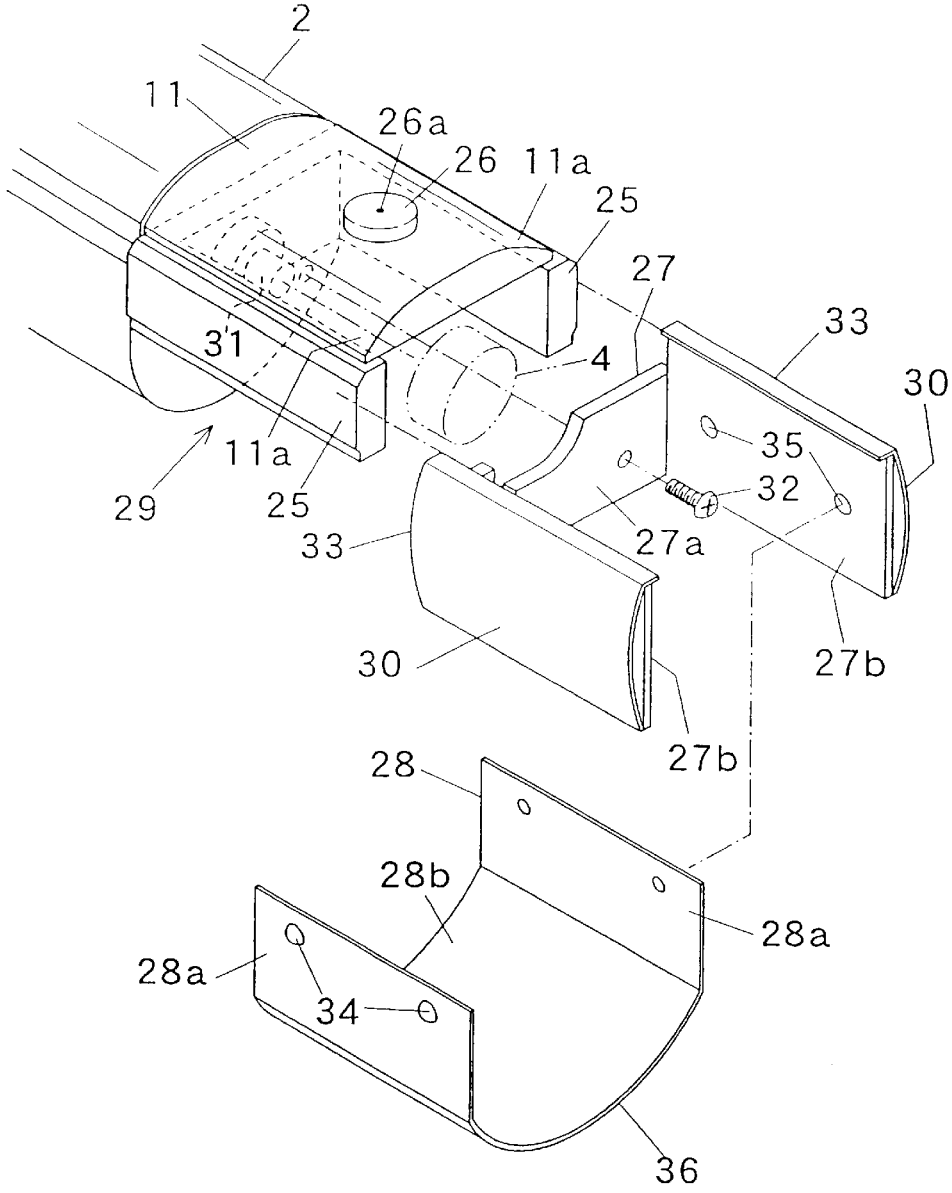
FIG. 3 is a disassembled perspective view showing a cylindrical frame guide device provided on the bed according to an embodiment of the invention.

As shown in FIG. 3, a pair of arms 25 is protrusively provided on the left and right sides of the front end of cylinder bed 2 and a needle plate 11 is horizontally affixed on arms 25. Curved surfaces 11*a* are formed on the left and right shoulder areas of needle plate 11 close to the inner surface of cylindrical frame 19, and a boss 26 equipped with a needle hole 26*a* is provided protruding low in the center flat area of needle plate 11. An opening 29 is formed below needle plate 11, the front end of a bobbin case drive shaft 31 extends into this opening 29, and bobbin case 4 is mounted on bobbin case drive shaft 31.

Also, a guide member 27 is provided in opening 29 for supporting cylindrical frame 19 from the inside. Guide member 27 consists of a connecting part 27*a* in the rear end and two side wall parts 27*b* on the left and right sides, together forming a rectangular shape, and connecting part 27*a* is detachably affixed with a screw 32 to the front end surface of cylinder bed 2 below bobbin case drive shaft 31 as side walls 27*b* are placed to cover the outside of the arms 25. A curved plate 33 is affixed by welding on the outside of each side wall part 27*b*, and these curved plates 33 form a partial cylindrical surface 30 that contacts concentrically with the inside of cylindrical frame 19 for side wall parts 27*b*.

A protection cover 28 is provided below guide member 27 and cover 28 covers bobbin case 4 from its underside. Protection cover 28 consists of flat parts 28*a* and a curved part 28*b* forming a U-shape as it is viewed from the front, wherein curved part 28*b* forms a partial cylindrical surface 36 having the same curvature as partial cylindrical surface 30 of guiding member 27 for cover 28. Semispherical protrusions 34 are provided on flat parts 28*a*, while holes 35 are provided on side walls 27*a* to fit with protrusions 34. Protection cover 28 is mounted detachably on guide member 27 by means of fitting between protrusions 34 and holes 35 as flat parts 28*a* are inserted on the inside of side wall parts 27*b*.

As shown in FIG. 4 through FIG. 7, cylindrical frame 19 comprises a sewing window 37 that exposes needle plate 11, an core material clamping member 38 that clamps down the core material C (see FIG. 7) covering sewing window 37 against cylindrical frame 19, a fabric clamping member 39 that clamps down the work fabric W that is covering the core material C together with the core material C against cylindrical frame 19, and a support member 40 that supports the core material C and the work fabric W in the middle position of sewing window 37. The core material C is a shape keeping material to prevent the work fabric W from sinking and is made of cardboard, unwoven fabric, etc. If the work fabric W consists of a rigid material such as leather and felt, it is possible to sew by stretching the work fabric W direction over cylindrical frame 19 without using the core material C.

Sewing window 37 is formed to a length corresponding to the axial stroke length of cylindrical frame 19, while a slip guard 42 made of rubber is glued on cylindrical frame 19 along the front and rear edges of sewing window 37 respectively and a tightener 43 made of strip steel or rubber is protrusively provided along the left and right side edges of sewing window 37. Support member 40 is formed into a curved shape having a curvature approximately equal to that of the outside diameter of cylindrical frame 19 and is fastened at fastening areas 40*a* at each end with screws 44 that are screwed onto screw holes 43*a* of tighteners 43 in an axially adjustable manner spanning over sewing window 37. A notch 45 is formed on rear mounting part 19*a* of cylindrical frame 19 to allow spring 23 of drive ring 7 to enter. The inside of the front end of cylindrical frame 19 is attached with an annular plate 46, at a portion of which is provided with a protruding positive stop 47 for positioning the core C from the front end.

Core material clamping member 38 made of a steel strip is formed in an oblong shape in the axial direction (longer than sewing window 37) on the left and right hand sides of cylindrical frame 19 respectively under tightener 43. The rear end of core material clamping member 38 is affixed to flange 21 with a screw 49 on the left and right sides of cylindrical frame 19 respectively, while the front end of core material clamping member 38 is provided in such a way as to be able to open individually to the left and right relative to cylindrical frame 19. At multiple places inside of core material clamping member 38, clamping pieces 50 are provided, which are formed being bent in an angle going from top to bottom for elastically contacting the core material C. At the front end of core material clamping member 38, temporary latches 51 are formed bending them inward, in such a way that temporary latches 51 can elastically engage with annular plate 46 through notches 52 provided on cylindrical frame 19 in order to hold core material clamping member 38 temporarily in a closed state.

Fabric clamping member 39 comprises, provided on the left and right sides, a pair of fabric clamps 56 that are oblong in the axial direction and open at the front end. The rear ends of the left and right fabric clamps 56 are connected by a connecting part 55 thus causing fabric clamping member 39 to have substantially a rectangular shape with an open ended front. Fabric clamps 56 are each made of a steel strip and to a length approximately equal to that of core material clamping member 38 and are facing core material clamping member 38 from the outside. Slip guards 53 made of rubber plates with grooves that are intended to sandwich the work fabric W with fabric clamps 56 are glued on the outside of core material clamping member 38. Connecting part 55 is made of a steel plate in a shape to go across cylindrical frame 19, and a bracket 57 is attached to its left side. A threaded shaft 58 is provided on bracket 57 on the outside of the left fabric clamp 56, and fabric clamping member 39 is fastened to flange 21 of cylindrical frame 19 by means of threaded shaft 58 in such a way that it can open or close in the lateral (left and right) direction.

An oblong surface fastener tape 60 is adhered to the outside surface of each fabric clamp 56 and a surface fastener belt 61 with open ends are latched to this tape 60 in such a way as to be adjustable in the axial direction in order to coordinate with support member 40. An engaging hole 62 is provided at the front end of the left and right fabric clamps 56 and a surface fastener belt 63 is threaded through engaging hole 62. The left and right fabric clamps 56 and the left and right core material clamping members 38 can be tightened against cylindrical frame 19 in the front and rear of needle plate 11 where the sewing actions occur by means of the front and rear fastener belts 61 and 63. Surface fastener belts 61 and 63 can be provided with surface fasteners for the entire surface on the front and back or can be provided only on both ends.

The method of using fabric tensioning device 18 in a sewing machine constituted as described in the above will be described as follows: In embroidering a piece of tube-like fabric, as shown in FIG. 1, set cylindrical frame 19 to cover the outside of cylinder bed 2, fit mounting area 19*a* into drive ring 7, clamp flange 21 to spring 23, cause lever 22 to engage with engaging piece 20, and mount cylindrical frame 19 tightly on drive ring 7.

Figure 7:
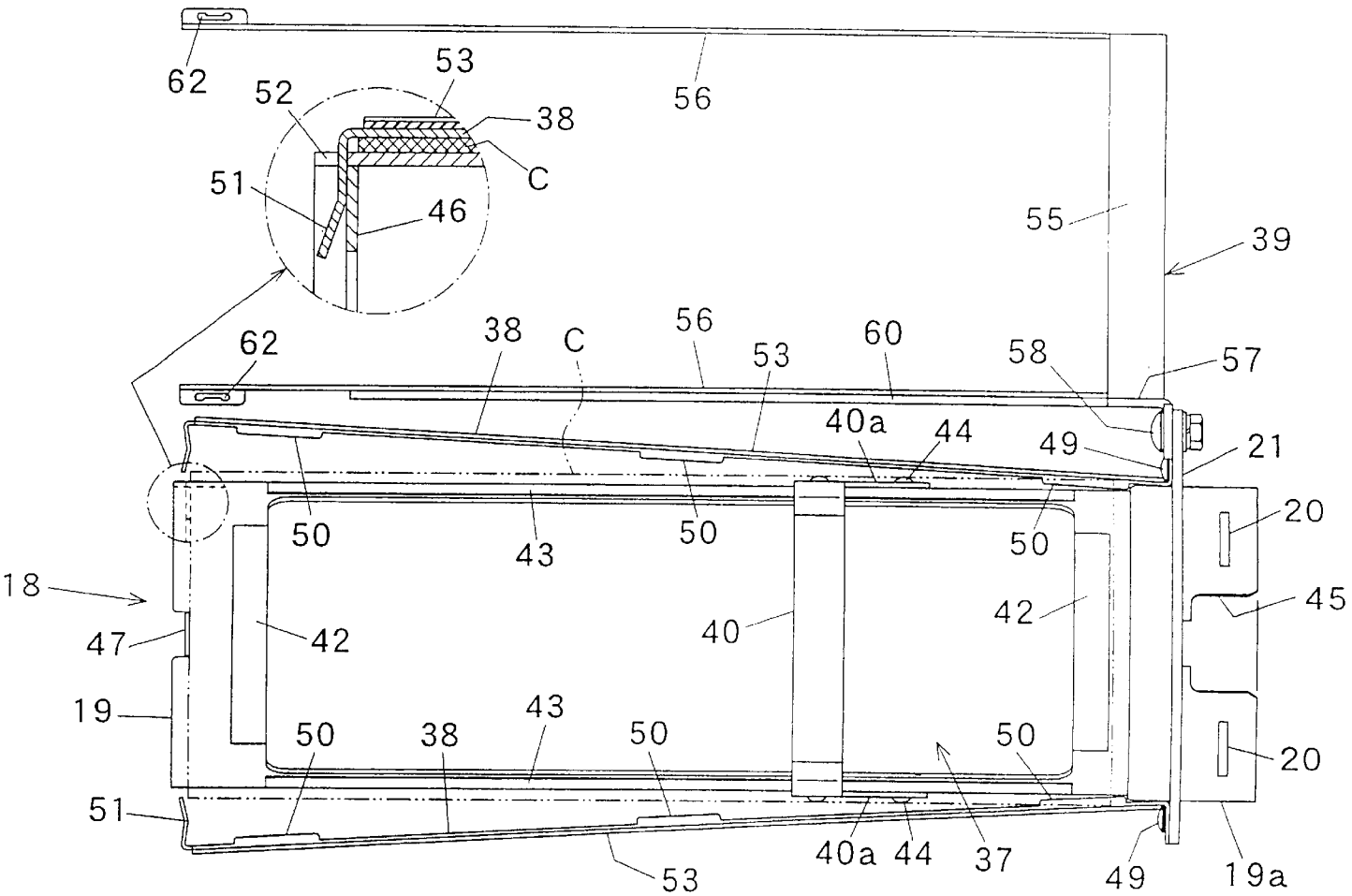
FIG. 7 is a plan view of the fabric tensioning device according to an embodiment of the invention.
Figure 8:
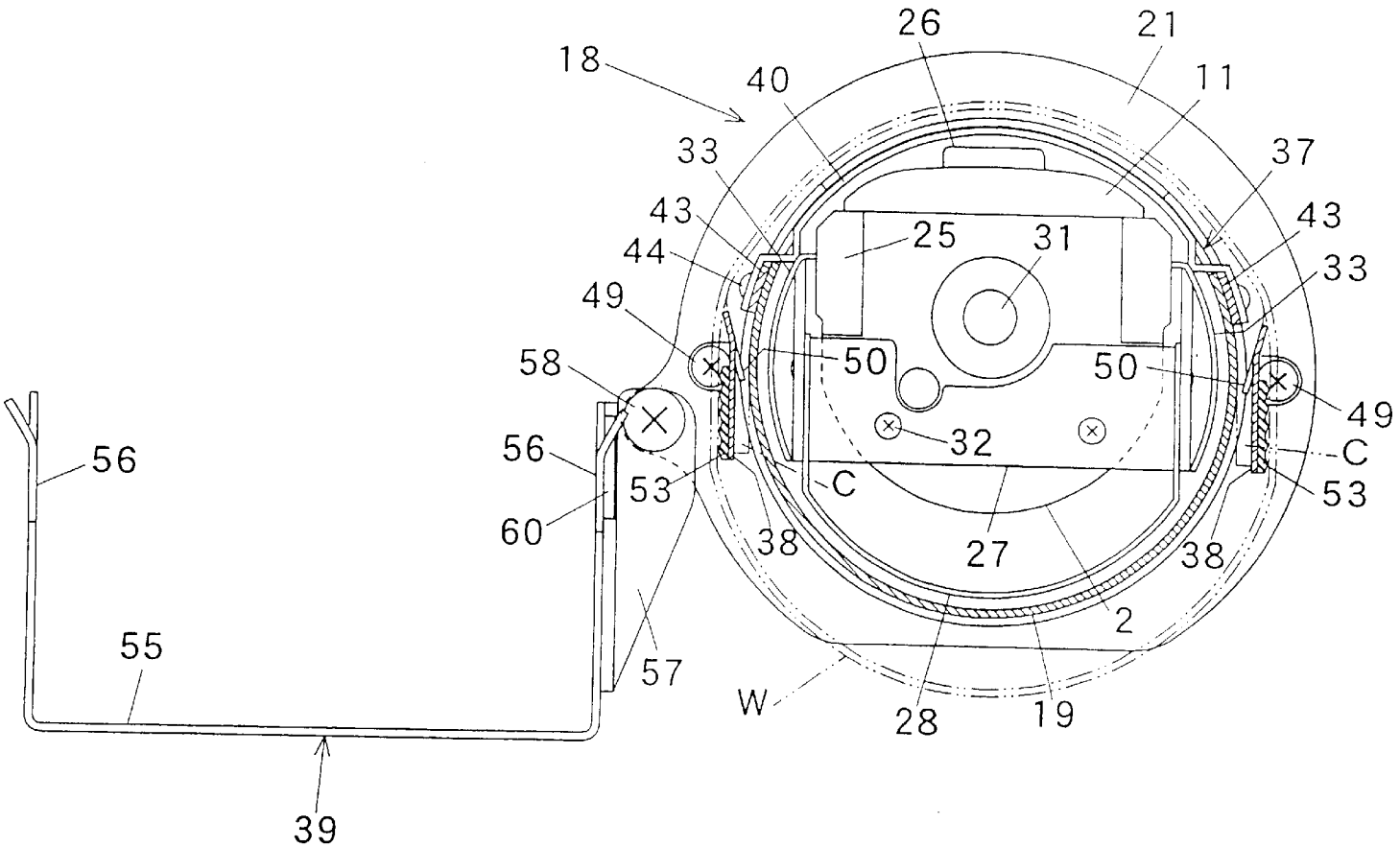
FIG. 8 is a cross-sectional view showing how an core material and a work fabric are mounted on the fabric tensioning device according to an embodiment of the invention.

Next, as shown in FIG. 7 and FIG. 8, move open fabric clamping member 39 toward left side of cylindrical frame 19, and make the core material C to abut against positive stop 47, to be supported by supporting member 40, to cover sewing window 37, and to be clamped down against cylindrical frame 19 to be stretched by means of core material clamping members 38 on the left and right sides. According to fabric tensioning device 18 of this embodiment, the following operating advantages can be achieved:

(1) Since two core material clamping members 38 on the left and right sides are attached to cylindrical frame 19 in such a way as to be able to open independently, it is possible to clamp down the core material C against cylindrical frame 19 on the left and right side independently and align it against the outer periphery of cylindrical frame 19 easily and accurately. More specifically, after clamping the left side of the core material with the left core material clamping member 38, adjust the shape of the remaining portion of the core material C, and clamp the right side of the core material with the right core material clamping member 38 to stretch the entire core material C in a smooth cylindrical shape; the order can be reversed to start with the right side as well.

(2) Since the front ends of the left and right side core material clamping members 38 are arranged in such a way as to be able to open toward the left and right sides of cylindrical frame 19 respectively, in contrast to the prior art wherein the clamping member opened and closed in the vertical direction, the core material C is less likely to be stretched in a skewed manner and the material can be easily stretched against cylindrical frame 19 evenly from the front to the rear at the same height.

(3) Since temporary latches 51 are provided at the front end of core material clamping member 38, the core material C can be held in a smooth cylindrical shape by temporarily latching one side of the core material C, which makes it easy to adjust the other side of the work fabric W with both hands and to stretch it out neatly.

(4) Since the core material clamping members 38 are provided below tighteners 43, it is possible to securely prevent the core material C from slacking and deformation while it is temporarily latched.

(5) Since multiple clamping pieces 50 are provided in the inside of core material clamping members 38, it is possible to hold various parts of the core material C with an even force using core material clamping members 38 which are oblong in the axial direction.

Figure 9:
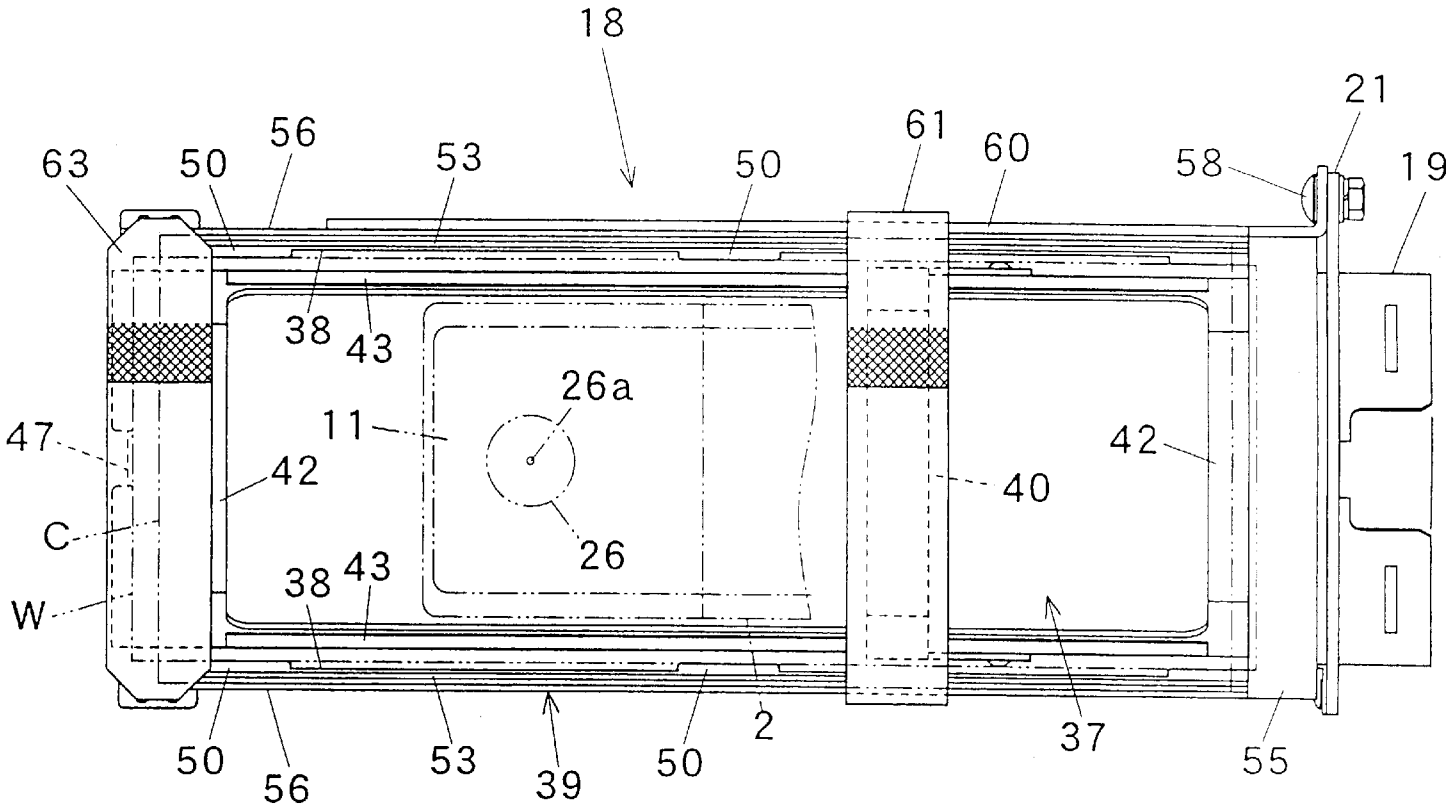
FIG. 9 is a plan view showing how the core material and the work fabric are tensioned according to an embodiment of the invention.
Figure 10:
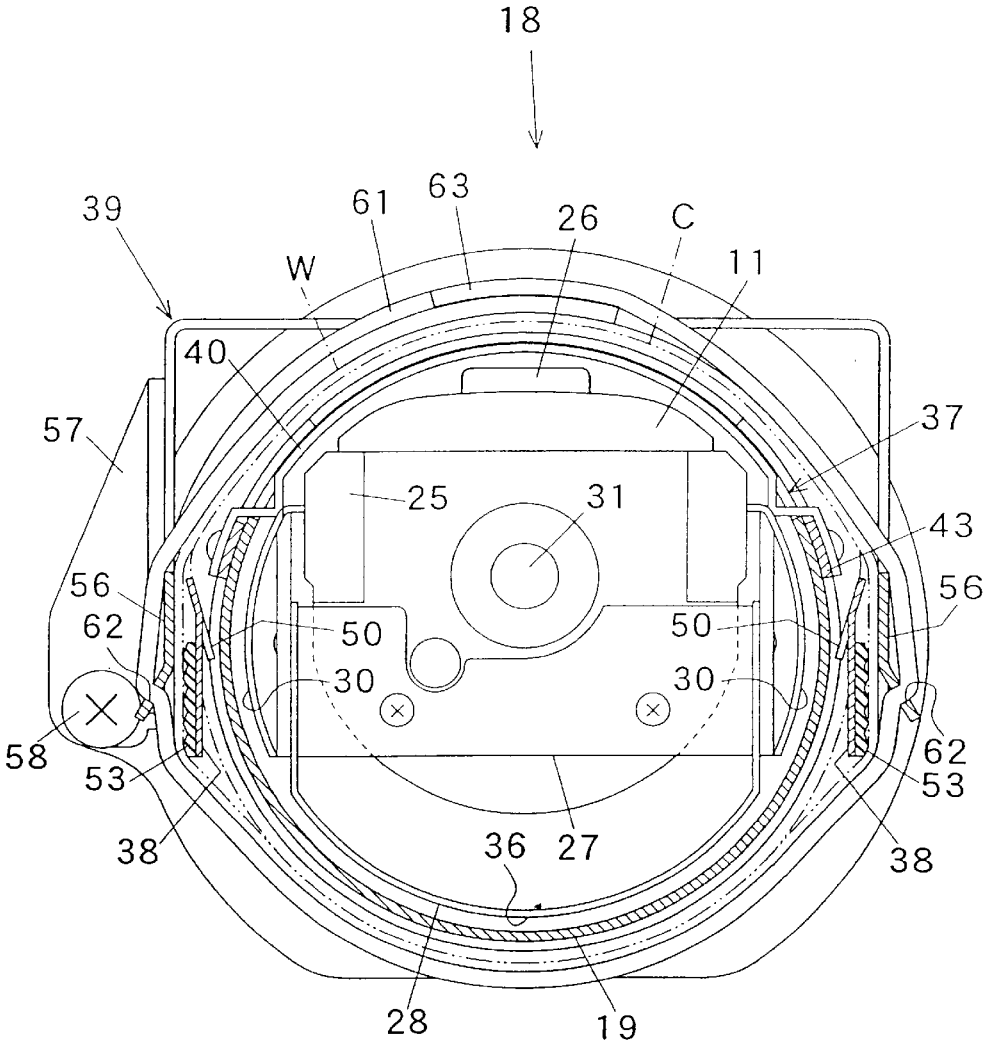
FIG. 10 is a cross-sectional view showing how the core material and the work fabric are tensioned according to an embodiment of the invention.
Figure 11:
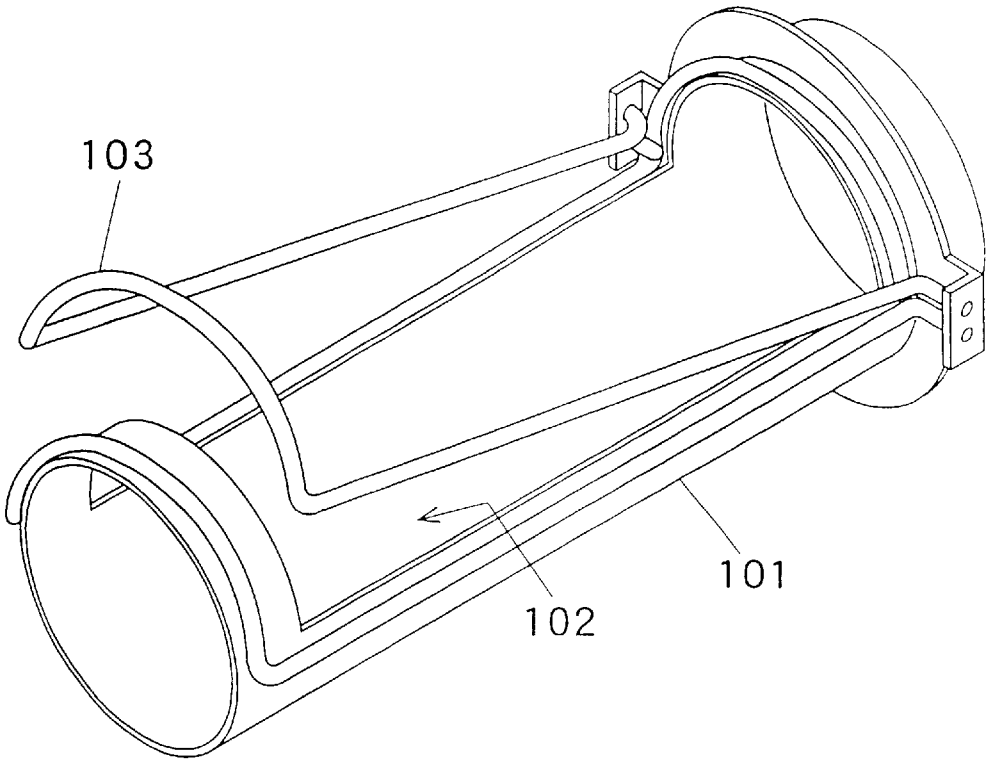
FIG. 11 PRIOR ART
FIG. 11 is a perspective view of a fabric tensioning device of the prior art.

Next, place the work fabric W on top of the core material C as shown in FIG. 9 and FIG. 10, close down fabric clamping member 39, and clamp down the work fabric W via the core material C against cylindrical frame 19 with the left and right fabric clamps 56. Next, make both ends of the front and rear surface fastener belts 61 and 63 contact and stick together, and tighten them in order to cause fabric clamps 56 to tighten against cylindrical frame 19 together with core material clamping members 38 to stretch the work fabric W against cylindrical frame 19. According to fabric tensioning device 18 of this embodiment, the following operating advantages can be achieved:

(6) Since the two fabric clamps 56 on the left and right sides are tightened against cylindrical frame 19 by means of two surface fastener belts 61 and 63 in the front and rear, the work fabric W is evenly clamped down on four sides of needle plate 11 thus making it possible to stretch it out securely on cylindrical frame 19 without causing any clamp marks or slacks.

(7) Since fabric clamping member 39 is provided in such a way as to be able to open or close in the lateral direction, the core material C and the work fabric W can be neatly and quickly spread out to cover the fully exposed sewing window 37 (see FIG. 7).

(8) Since fabric clamping member 39 is pivot mounted on flange 21 via threaded shaft 58 located on the outside of the left side fabric clamp 56, it is possible to provide a wide space between the left side fabric clamp 56 and cylindrical frame 19 when fabric clamping member 39 is opened, allowing the core material C and the work fabric W to be inserted in that space easily. (See FIG. 8)

(9) Since the left and right fabric clamps 56 are facing the left and right core material clamping members 38 from the outside, they can be tightened together with two surface fastener belts 61 and 63 to hold the work fabric W and the core material C against cylindrical frame 19 solidly and simultaneously.

(10) Since the slip guards 53 are provided on the outside surfaces of the core material clamping members 38, the work fabric W can be clamped without any slacks between core materials clamping members 38 and fabric clamps 56.

(11) Since surface fastener belts 61 and 63 having open ends on one side are used, fabric clamps 56 can be tightened by one-touch operation without causing any slacks.

(12) Since the rear surface fastener belt 61 is engaged with surface fastener tape 60 in such a way as to be adjustable in the axial direction, it is possible to tighten fabric clamps 56 closer to the back of the embroidering position as needed according to the embroidering pattern.

(13) Since the front surface fastener belt 63 is threaded through engaging hole 62 of fabric clamp 56, this belt 63 is less likely to get lost.

According to a sewing machine of this embodiment, the following operating advantages can be achieved:

(14) Since cylindrical frame 19 is guided by means of guide member 27, which is independent of needle plate 11, it is possible to install needle plate 11 permanently on cylinder bed 2 in order to use it not only for cylindrical frame 19 but also to other type of frames such as a rectangular frame and an annular frame, thus eliminating the needs of replacing needle plate 11 on different applications.

(15) Since curved surfaces 11*a* are provided on the left and right shoulder areas of needle plate 11 facing the inner surface of cylindrical frame 19 in close ranges, it is possible to feed the work fabric W smoothly without being stuck on needle plate 11 and to provide a wide area on needle plate 11 for supporting the work fabric.

(16) Since partial cylindrical surface 30 is formed on the left and right side walls 27*b* of guide member 27 concentric with cylindrical frame 19 in a close range, cylindrical frame 19 can be guided in parallel with cylinder bed 2 in high precision.

(17) Since guide member 27 is formed in a open-ended rectangular shape, it is possible to attach guide member 27 rigidly on cylinder bed 2 via its connecting part 27*a,* thus effectively preventing vibration.

(18) Since partial cylindrical surface 30 is formed on the left and right side A walls 27*b,* it is possible to install bobbin case 4 and form a wide area of partial cylindrical surface 30 effectively using the limited space underneath needle plate 11 effectively.

(19) Since protection cover 28 is provided detachably on guide member 27, bobbin cage 4 is not exposed and makes it safer when cylindrical frame 19 is not used, while the bobbin case 4 can be easily removed or installed by removing cover 28 during the bobbin exchange.

(20) Since partial cylindrical surface 36 is formed on protection cover 28, this guide surface 36 provides a wide surface for guiding cylindrical frame 19 in cooperation with partial cylindrical surface 30 of guide surface 27.

This invention should not be construed to be restricted with the embodiment described above, but rather can be materialized in various other ways without leaving the gist of the invention as exemplified below:

(a) To pivot-mount fabric clamping member 39 by a shaft at the rear end so that it can open or close vertically;

(b) To form the entire structure of fabric clamping member 39 with a rod material in an open-ended rectangular shape;

(c) To form a slit oblong in the axial direction in one of fabric clamps 56 of fabric clamping member 39, and cause the rear belt 61 to be engaged with this slit in such a way as to make its position adjustable;

(d) To form core material clamping member 38 with a rod material in a shape oblong in the axial direction;

(e) To support core material clamping member 38 at its rear end via a shaft and spring mechanism rotating relative to cylindrical frame 19.

(f) To provide core material clamping member 38 and fabric clamps 56 in positions vertically separated on both left and right sides of cylindrical frame 19; and (g) To form a portion of the guide device for cylindrical frame 19 that corresponds to protection cover 28 integral with guide member 27 and provide on the outside of guide member 27 a partial cylindrical surface with an open portion at the top like a C-shape.

As can be seen from the above, the fabric tensioning device for a sewing machine according to this invention, the two fabric clamps on the left and right sides of the fabric clamping member are tightened against the cylindrical frame with two belts at the front and rear sides thereof, so that the work fabric can be clamped on four sides of the sewing area, providing an excellent result in securely tensioning the fabric on the circular frame causing no clamping marks or slacks.

What is claimed is:

1. A fabric tensioning device for tensioning a fabric to be sewed in a stitch forming area of a sewing machine, said device comprising:

a cylindrical frame having a sewing window and extending in the longitudinal direction; and a fabric clamping member for clamping down against said cylindrical frame a fabric to be sewed that is covering said sewing window, wherein said fabric clamping member opens and closes on said cylindrical frame, and said fabric clamping member comprises a pair of opposing fabric clamps on the left and right hand side that are oblong in the longitudinal direction having open-ended front edges, wherein said fabric clamps are tightened against said cylindrical frame in the front and rear sides of the stitch forming area by a pair of belts in the front and rear.

2. A fabric tensioning device of a sewing machine described in claim 1 wherein said left and right fabric clamps connect at their rear end to form a rectangle with an open front end; and the rear end of said fabric clamps is attached to said cylindrical frame by a pivot shaft provided on the outside of one of the fabric clamps.

3. A fabric tensioning device of a sewing machine described in claim 1 wherein said pair of belts comprise surface fastener belts with open ends.

4. A fabric tensioning device of a sewing machine described in claim 3 wherein a surface fastener is provided on said one of the fabric clamps and is adapted to adjust said rear belt's position in the front and rear direction.

5. A fabric tensioning device of a sewing machine described in claim 3 wherein a hole is provided at the front end of said left and right fabric clamps respectively to thread the front belt through.

* * * * *